US009546667B2

(12) United States Patent
Chen

(10) Patent No.: US 9,546,667 B2
(45) Date of Patent: Jan. 17, 2017

(54) FAN WITH METALLIC HUB AND PLASTIC IMPELLER AND METHOD FOR MANUFACTURING SUCH FAN

(71) Applicant: Foxconn Technology Co., Ltd., New Taipei (TW)

(72) Inventor: Wen-Cheng Chen, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 922 days.

(21) Appl. No.: 13/717,548

(22) Filed: Dec. 17, 2012

(65) Prior Publication Data

US 2013/0259692 A1 Oct. 3, 2013

(30) Foreign Application Priority Data

Mar. 27, 2012 (TW) ..... 101110500

(51) Int. Cl.

| | |
|---|---|
| ***F01D 5/14*** | (2006.01) |
| ***F04D 29/26*** | (2006.01) |
| ***F04D 29/60*** | (2006.01) |
| ***F04D 29/02*** | (2006.01) |
| ***F04D 29/28*** | (2006.01) |

(52) U.S. Cl.

CPC ..... *F04D 29/26* (2013.01); *F04D 29/023* (2013.01); *F04D 29/263* (2013.01); *F04D 29/281* (2013.01); *F04D 29/601* (2013.01); *F05D 2230/53* (2013.01); *F05D 2300/43* (2013.01); *Y10T 29/49316* (2015.01)

(58) Field of Classification Search

CPC ..... F04D 29/26; F04D 29/263; F04D 29/281; F04D 26/0613; F04D 29/023; F04D 17/16

See application file for complete search history.

(56) References Cited

U.S. PATENT DOCUMENTS

| | | | | | |
|---|---|---|---|---|---|
| 5,478,206 | A * | 12/1995 | Prahst | F04D 29/281 | 416/186 R |
| 5,655,882 | A * | 8/1997 | Morgan | F04D 29/325 | 416/204 R |
| 9,011,090 | B2 * | 4/2015 | Huang | F04D 29/4226 | 415/206 |
| 2002/0141871 | A1 * | 10/2002 | Medamaranahally | F04D 29/326 | 416/193 R |
| 2012/0057966 | A1 * | 3/2012 | Chen | F04D 29/281 | 415/170.1 |

FOREIGN PATENT DOCUMENTS

| | | | | |
|---|---|---|---|---|
| CN | 101776084 | A | 7/2010 | |
| DE | 102004006933 | A1 * | 9/2005 | F04D 25/0613 |
| TW | M252813 | U | 12/2014 | |

* cited by examiner

*Primary Examiner* — Craig Kim
*Assistant Examiner* — Jason Fountain
(74) *Attorney, Agent, or Firm* — Zhigang Ma

(57) ABSTRACT

An exemplary fan includes a hub and an impeller. The hub is made of metal, and includes a flange. The impeller is made of plastic. The impeller is formed around the hub and has the flange embedded therein. A method for manufacturing the fan is also provided.

13 Claims, 3 Drawing Sheets

FAN WITH METALLIC HUB AND PLASTIC IMPELLER AND METHOD FOR MANUFACTURING SUCH FAN

BACKGROUND

1. Technical Field

The present disclosure relates to fans such as those used in electronic devices, and more particularly to a fan with a metallic hub and a plastic impeller and a method for manufacturing such fan.

2. Description of the Related Art

With the ongoing development of the electronics industry, electronic components (such as central processing units) operate at higher speeds and higher frequencies than previously. The heat generated by such electronic components during operation is correspondingly increased. If the heat generated by an electronic component is not efficiently dissipated, the electronic component and even the host electronic device may malfunction or suffer damage. Therefore, the heat must be timely removed to keep the temperature of the electronic device within a safe range. Fans have been used in numerous electronic devices for providing forced airflow to dissipate the heat.

Generally, a fan comprises a hub and an impeller. A plurality of blades surrounds the impeller. The hub and the impeller can be made of a single piece of a desired kind of material. For example, the hub and the impeller can be made of metal, and formed by a punching method. However, the punching process is unable to achieve blades with complex shapes. The hub and the impeller can also be made of plastic, with the impeller being formed by an injection molding method. However, using plastic can not achieve blades with high strength. Alternatively, the hub and the impeller can be made of two different kinds of material individually, and then the hub and the impeller are assembled together with glue or fasteners. However, the process of assembly is complex, and the impeller can not achieve high strength at joints of the hub and the impeller.

What is needed, therefore, is a fan which can overcome the above-described shortcomings.

BRIEF DESCRIPTION OF THE DRAWINGS

Many aspects of the present fan and method can be better understood with reference to the following drawings. The components in the drawings are not necessarily drawn to scale, the emphasis instead being placed upon clearly illustrating the principles of the present fan and method. Moreover, in the drawings, like reference numerals designate corresponding parts throughout the views.

DETAILED DESCRIPTION

Figure 1:
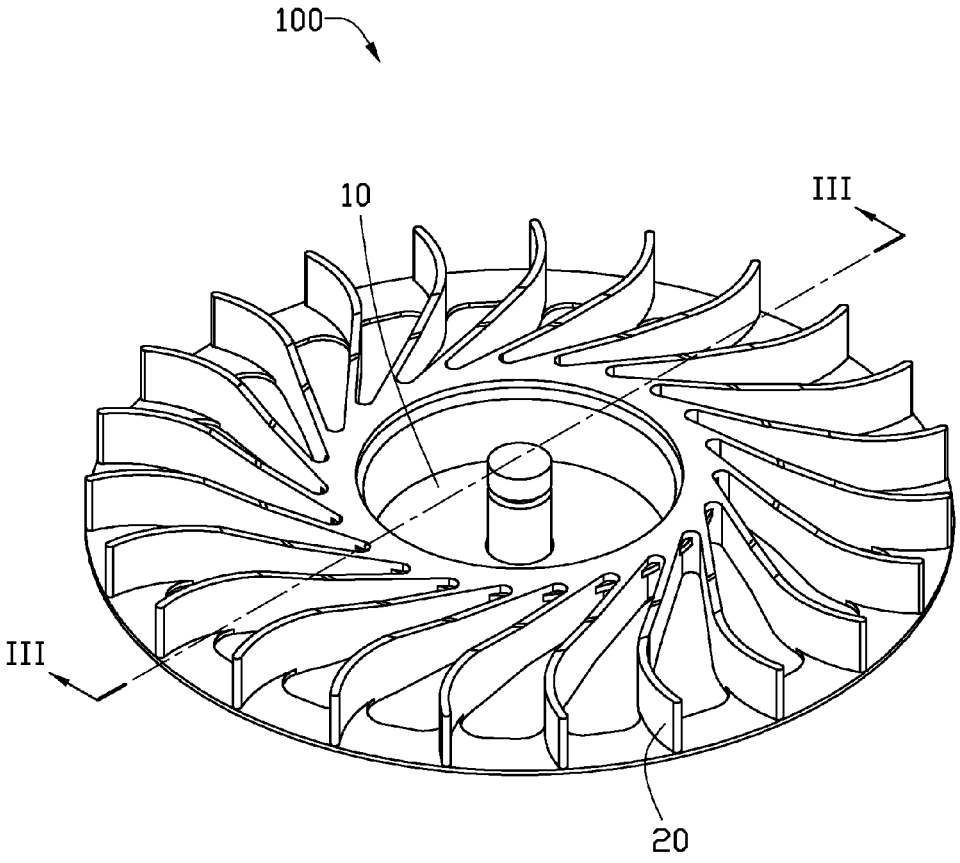
FIG. 1 is an assembled, isometric view of a fan in accordance with an embodiment of the disclosure, showing the fan inverted.

Referring to FIG. 1, a fan 100 according to an exemplary embodiment is shown. The fan 100 includes a hub 10, and an impeller 20 surrounding the hub 10.

Figure 2:
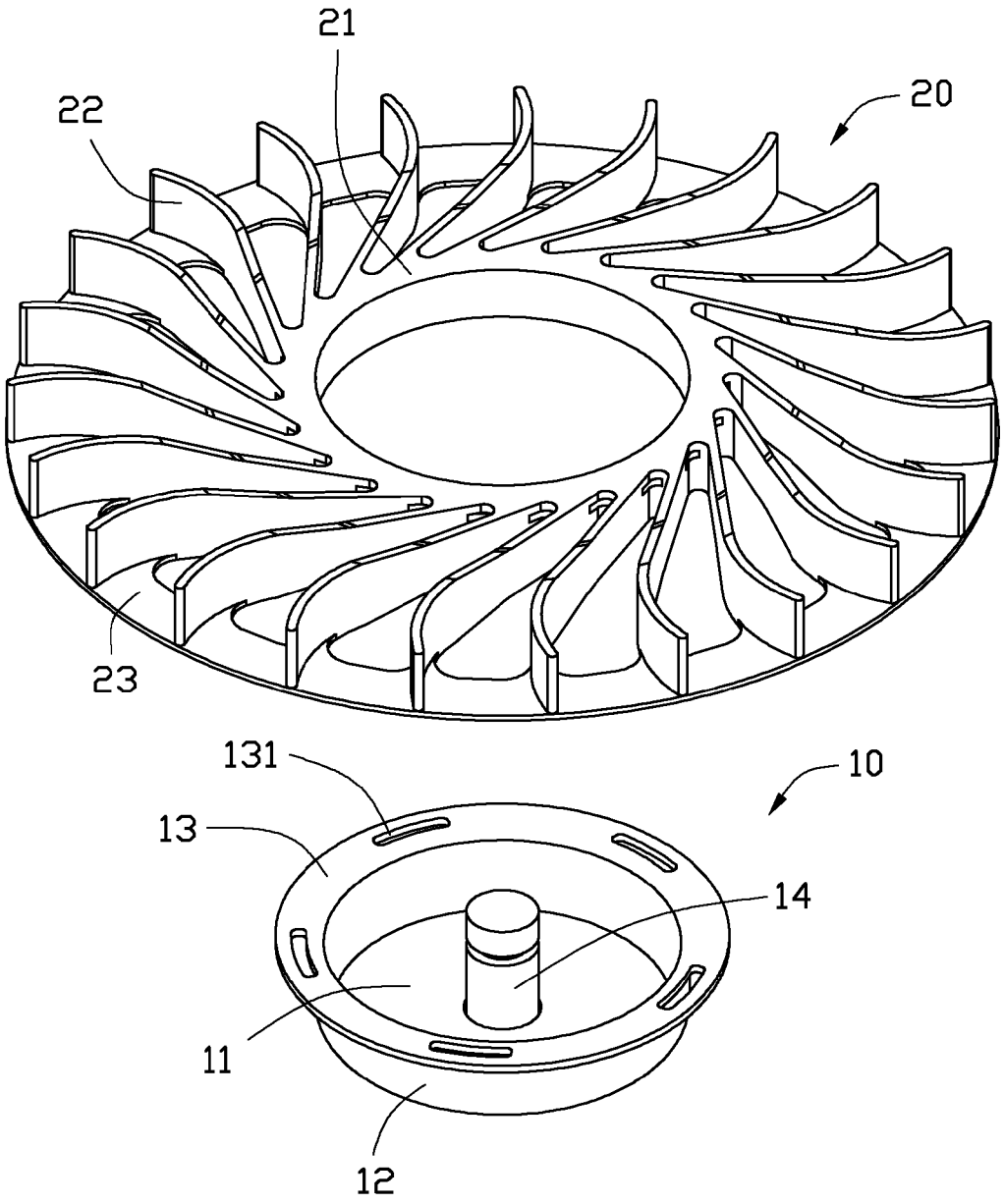
FIG. 2 is an exploded view of the fan of FIG. 1.

Referring also to FIG. 2, the hub 10 is substantially hat-shaped. The hub 10 includes a top wall 11, a cylindrical wall 12, a flange 13, and a central shaft 14. The top wall 11 is substantially circular. The cylindrical wall 12 extends axially and downwardly from a periphery of the top wall 11. As such, the cylindrical wall 12 is perpendicular to the top wall 11. The flange 13 extends radially and outwards from a bottom edge of the cylindrical wall 12, and thereby has an annular configuration and is coaxial with the cylindrical wall 12. The flange 13 is parallel to the top wall 11. A plurality of slots 131 are defined in the flange 13, for fixing the impeller 20 on the hub 10. In this embodiment, there are five slots 131 evenly arranged along a circumferential direction of the flange 13. The shaft 14 extends downwardly from a bottom surface of the top wall 11, and is rotatable with respect to a stator (not shown) of the fan 100.

The hub 10 is made of metal, and formed by punching. When the fan 100 operates, the metallic hub 10 is capable of providing magnetic force for a corresponding motor (not shown), without the need for any coils to be mounted in the hub 10. Furthermore, because the strength of metallic material is typically higher than that of plastic material, the hub 10 can be made thinner to achieve a larger inner space within the cylindrical wall 12, while still retaining enough strength. The larger inner space of the hub 10 can provide more mounting room for accommodating elements. Alternatively, the outer size of the hub 10 can be reduced, with the inner space of the hub 10 remaining unchanged. When the outer size of the hub 10 is smaller, the hub 10 occupies less space and can provide more space for airflow.

Figure 3:
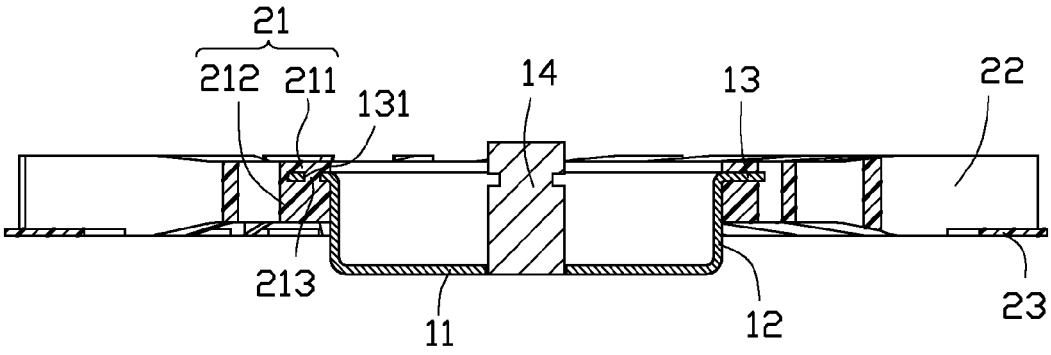
FIG. 3 is a cross-sectional view of the fan of FIG. 1, taken along line III-III thereof.

Referring also to FIG. 3, the impeller 20 and the hub 10 are manufactured individually, insofar as the hub 10 is manufactured first, and only after that the impeller 20 is manufactured. The impeller 20 includes a blade ring 21, a plurality of blades 22 extending outwards from an outer circumferential surface of the blade ring 21 and spaced from each other, and an outer ring 23 interconnecting outer free ends of the blades 22. The blade ring 21 is engaged with the flange 13 of the hub 10. The blade ring 21 is divided into two portions, respectively designated as an upper portion 211 and a lower portion 212, with the flange 13 embedded in the blade ring 21 between the upper and lower portions 211, 212. The upper portion 211 is integrally connected to the lower portion 212 via connecting portions 213, which comprise the plastic material of the impeller 20 filled in the slots 131. That is, each connecting portion 213 interconnects the upper portion 211 with the lower portion 212, and thereby the impeller 20 is fixed on the hub 10. The blades 22 thus extend outwards from the flange 13 of the hub 10. The outer ring 23 is substantially flat.

The impeller 20 is made of plastic material, and formed by injection molding. The blade ring 21 embeds the flange 13 of the hub 10 once the injection molding is completed. Accordingly, the hub 10 is connected with the upper portion 211, the lower portion 212, and the connecting portion 213 after the injection molding, without the need for glue or fasteners. The connecting portion 213 is integrally formed with the upper portion 211 and the lower portion 212 as a single monolithic body (or piece), so that a joint between the hub 10 and the impeller 20 has high strength and good durability. The injection molding technique makes the process of connection of the hub 10 and the impeller 20 simple, and achieves a firm connection. Furthermore, the blades 22 can be formed in various shapes and distributions easily, due to the favorable characteristics inherent in typical plastic material and the injection molding process.

An exemplary method for manufacturing the fan 100 is described in detail below:

step 1: forming a metal hub 10 with a top wall 11, a cylindrical wall 12 and a flange 13; and step 2: forming a plastic impeller 20 engaging the flange 13 of the hub 10 by injecting molding.

In step 1, the hub 10 is made of a single metal piece by punching. The cylindrical wall 12 extends perpendicularly and downwardly from a periphery of the top wall 11. The flange 13 extends perpendicularly and radially outwards from a bottom end of the cylindrical wall 12. In addition, a plurality of slots 131 can be defined in the flange 13.

In step 2, a mold (not shown) is provided for the injection molding. In particular, the mold is positioned to surround the flange 13 of the hub 10. The mold is configured for making the impeller 20. Molten plastic material is then injected into the mold to fill the slots 131 and construct the blade ring 21, the blades 22 and the outer ring 23. The impeller 20 is thus formed on the flange 13 of the hub 10 after the molten plastic material is solidified.

In the fan 100 described above, the hub 10 is made of metal, the impeller 20 is made of plastic, and the impeller 20 is formed to embed the flange 13 of the hub 10 therein by the injection molding technique. Therefore the metal hub 10 can provide magnetic force for an associated motor without the need for any coils to be mounted in the hub 10, and the fan 100 can achieve high strength due the hub 10 being metal. Furthermore, the blades 22 can be formed in various shapes and distributions more easily than with other techniques (such as punching), because the impeller 20 is made of plastic and capable of being made by injection molding. Moreover, the injection molding process is a relatively simple method which can make the connection of the hub 10 and the impeller 20 firm, without the need for glue or fasteners.

It is to be further understood that even though numerous characteristics and advantages have been set forth in the foregoing description of the embodiments, together with details of the structures and functions of the embodiments, the disclosure is illustrative only; and that changes may be made in detail, especially in the matters of shape, size, and arrangement of parts within the principles of the disclosure to the full extent indicated by the broad general meaning of the terms in which the appended claims are expressed.

What is claimed is:

1. A fan, comprising:

a hub made of metal, the hub comprising a flange; and an impeller made of plastic, the impeller being an injection molded body formed around the hub and having the flange embedded therein;

wherein the impeller comprises a blade ring and a plurality of blades extending outwards from an outer circumferential surface of the blade ring, the blade ring comprises a bottom portion perpendicular to the outer circumferential surface, each of the plurality of blades comprises a bottom portion coplanar with the bottom portion of the blade ring, and the plurality of blades are spaced from each other, the impeller further comprises an outer ring interconnecting outer free ends of the plurality of blades, the outer ring comprises a bottom portion, the bottom portion of each of the plurality of blades is coplanar with the bottom portion of the outer ring.

2. The fan of claim 1, wherein the hub further comprises a top wall and a cylindrical wall extending axially and downwardly from a periphery of the top wall.

3. The fan of claim 2, wherein the flange extends radially and outwards from a bottom edge of the cylindrical wall.

4. The fan of claim 1, wherein a plurality of slots are defined in the flange of the hub, and the slots are filled with plastic material comprised in the impeller.

5. The fan of claim 4, wherein the plurality of slots is five slots evenly arranged along a circumferential direction of the flange.

6. The fan of claim 4, wherein the blade ring comprises an upper portion and a lower portion, with the flange embedded in the blade ring between the upper portion and lower portion.

7. The fan of claim 6, wherein the blade ring further comprises a plurality of connecting portions in the slots, respectively, the connecting portions comprise the plastic material filled in the slots, and the connecting portions interconnect the upper portion and the lower portion, with the upper portion, the connecting portions and the lower portion formed as a single monolithic body.

8. A fan, comprising:

a hub made of metal; and an impeller made of plastic, the impeller being an injection molded body formed around the hub;

wherein the impeller comprises a blade ring and a plurality of blades extending outwards from an outer circumferential surface of the blade ring, the blade ring comprises a bottom portion perpendicular to the outer circumferential surface, each of the plurality of blades comprises a bottom portion coplanar with the bottom portion of the blade ring, and the plurality of blades are spaced from each other, the impeller further comprises an outer ring interconnecting outer free ends of the plurality of blades, the outer ring comprises a bottom portion, the bottom portion of each of the plurality of blades is coplanar with the bottom portion of the outer ring.

9. The fan of claim 8, wherein the hub further comprises a top wall and a cylindrical wall extending axially and downwardly from a periphery of the top wall.

10. A method for manufacturing a fan, the method comprising:

forming a metal hub with a flange; and forming an impeller having the flange of the hub embedded therein by injection molding;

wherein the impeller comprises a blade ring and a plurality of blades extending outwards from an outer circumferential surface of the blade ring, the blade ring comprises a bottom portion perpendicular to the outer circumferential surface, each of the plurality of blades comprises a bottom portion coplanar with the bottom portion of the blade ring, and the plurality of blades are spaced from each other, the impeller further comprises an outer ring interconnecting outer free ends of the plurality of blades, the outer ring comprises a bottom portion, the bottom portion of each of the plurality of blades is coplanar with the bottom portion of the outer ring.

11. The method of claim 10, wherein the hub is integrally made of a single piece of metal by punching.

12. The method of claim 10, further comprising forming a plurality of slots in the flange of the hub before forming the impeller embedding the flange of the hub therein.

13. The method of claim 12, wherein forming the impeller embedding the flange of the hub therein further comprises providing a mold, positioning the mold to surround the flange of the hub, and injecting molten plastic material into the mold to fill the slots and construct a blade ring and a plurality of blades.

* * * * *